US007168344B1

(12) United States Patent
Jennings

(10) Patent No.: US 7,168,344 B1
(45) Date of Patent: Jan. 30, 2007

(54) ANTENNA WRENCH ON A KEY CHAIN

(76) Inventor: Kelvin Lee Jennings, 730 Area, McHenry, IL (US) 60051

( * ) Notice: Subject to any disclaimer, the term of this patent is extended or adjusted under 35 U.S.C. 154(b) by 0 days.

(21) Appl. No.: 11/355,277

(22) Filed: Feb. 15, 2006

(51) Int. Cl.
*B25F 1/02* (2006.01)

(52) U.S. Cl. ..... 81/177.1; 81/177.2; 81/177.5

(58) Field of Classification Search ..... 81/177.1, 81/177.2, 177.5, 485; 343/175, 880, 900, 343/901

See application file for complete search history.

(56) References Cited

U.S. PATENT DOCUMENTS

| | | | | |
|---|---|---|---|---|
| 1,338,181 | A | 4/1920 | Kalbrenner | |
| 1,861,207 | A * | 5/1932 | Burns | 81/119 |
| 2,875,442 | A * | 2/1959 | Benis et al. | 343/889 |
| 3,544,140 | A | 12/1970 | Langheck | |
| 3,671,067 | A | 6/1972 | Wegner et al. | |
| 4,021,809 | A | 5/1977 | Klancnik | |
| 4,242,684 | A * | 12/1980 | Wolverton | 343/715 |
| 4,631,770 | A * | 12/1986 | Goldberg | 7/167 |
| 5,308,178 | A | 5/1994 | Jiang | |
| 5,862,725 | A | 1/1999 | Negus | |
| 6,588,306 | B1 | 7/2003 | Grossman et al. | |
| 6,592,219 | B1 * | 7/2003 | Tsai | 351/42 |
| 6,666,110 | B1 | 12/2003 | Buettner | |
| 2003/0221518 | A1 | 12/2003 | Buettner | |

* cited by examiner

*Primary Examiner*—Lee D. Wilson
*Assistant Examiner*—Anthony Ojini
(74) *Attorney, Agent, or Firm*—Mathew R. P. Perrone, Jr.

(57) ABSTRACT

A wrench assembly is mounted on a key ring, which keeps the wrench readily available for use in removing a vehicle antenna for washing the vehicle or reattaching the antenna after the vehicle. The wrench also protects the antenna mount by being temporarily attached thereto while the vehicle is being washed.

19 Claims, 4 Drawing Sheets

ANTENNA WRENCH ON A KEY CHAIN

This invention relates to an antenna wrench on a key chain, and more particularly, to an antenna wrench mounted on a key chain, which can be easily removed and placed in the aperture left by the removed antenna.

BACKGROUND OF THE INVENTION

With the increased popularity of automatic carwashes, it is desirable to make such a carwash very efficient in the cleaning of the vehicle. One of the major problems in using an automatic carwash is the effect of the carwash on a vehicle antenna.

If the antenna remains in place during the carwash or vehicle wash, great stress is placed on the antenna. Such stress on the antenna can lead to a breaking of the antenna. Even worse, the fender of the vehicle on whcih the antenna is mounted can be damaged. An efficient manner for avoiding these problems is the removal of the antenna.

However, such an action requires a wrench. Typically, such a wrench is difficult to find. It is very desirable to simplify this problem. However, no particularly efficient way of keeping such a wrench available is known.

Furthermore, the removal of the antenna leaves an aperture which can fill with water, as the vehicle is being washed. Water in that aperture can cause a number of problems. The aperture can become corroded. The aperture may also be closed due to the freezing of the water therein, especially when the vehicle is washed on a cold day.

Thus, it is very desirable to minimize these problems while taking advantage of the automatic vehicle wash. It is further advantageous to have these problems minimized in a simple fashion.

SUMMARY OF THE INVENTION

Among the many objectives of this invention is the provision of a wrench assembly mounted on a key ring so that the wrench is easily separable from the key ring.

A further objective of this invention is the provision of a wrench assembly having a wrench in threaded relation with a mounting base.

Yet a further objective of this invention is the provision of a wrench assembly, wherein the wrench may fit into a space on the vehicle left by the removed antenna.

These and other objectives of the invention (which other objectives become clear by consideration of the specification, claims and drawings as a whole) are met by providing a wrench assembly mounted on a key ring, which keeps the wrench readily available for use.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

In accordance with functions of the wrench assembly, which can be mounted on a key ring other suitable support of this invention, a mounting base is secured to the key ring or other desired support at a supporting end thereof. At the opposing end of the mounting base, is a receiving member for a wrench. The wrench has a mating member at one end, which is joinable to the receiving member. Oppositely disposed from the mating member is a gripping member, suitable for holding antenna base or other desired fastening member for loosening or tightening thereof.

Figure 1:
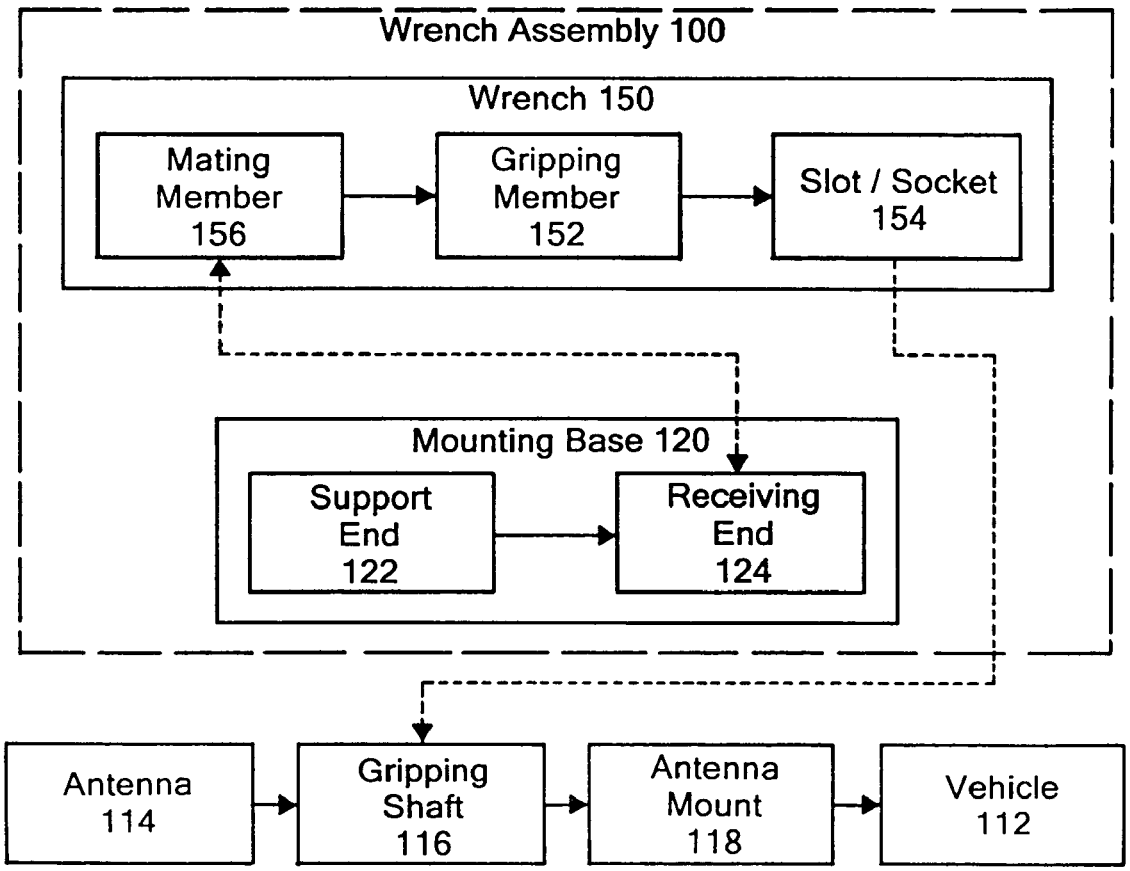
FIG. 1 depicts a box diagram of an antenna wrench assembly 100 of this invention mounted on a key chain 110.

Referring now to FIG. 1, a wrench assembly 100 may remove an antenna 114 from a vehicle 112. Vehicle 112 may be any form of transportation which amounts an antenna 114, including but not limited to automobiles and trucks. Wrench assembly 100 permits the antenna 114 to be efficiently removed from the vehicle 112, when desired, and also remounted thereon, when necessary. More importantly, wrench assembly 100 protects the vehicle 112 antenna mount 118 from moisture during washing.

Wrench assembly 100 has a mounting base 120, with a wrench 150 releasably secured thereto. Mounting base 120 includes the supporting end 122. Oppositely disposed from supporting end 122, on mounting base 120 is receiving member 124. Wrench 150 includes a gripping member 152 with an optional slotted socket 154 therein. Oppositely disposed from gripping member 152 on wrench 150 is a mating member 156 connects with mounting base 120. Receiving member 124 cooperates with gripping member 152 in order to join wrench 150 to mounting base 120 in a realeasable fashion.

Gripping member 152 of wrench 150 is shaped to fit the gripping shaft 116 of the antenna 114 for removal thereof. The antennas 114 of transportation vehicles models often come with gripping shafts 116 of varying shapes and configurations. While many antennas 114 work with one gripping member 152, as the examples in the described figures illustrate, the gripping member 152 is adaptable to fit antennas 114 with any gripping shaft 116 configuration.

Figure 2:
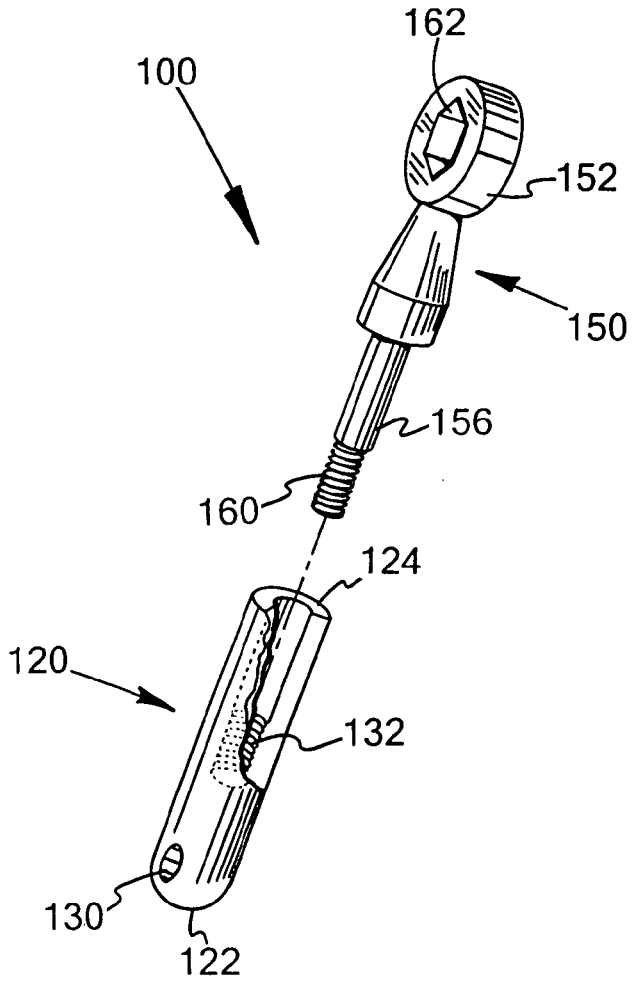
FIG. 2 depicts an exploded, perspective view of an antenna wrench assembly 100 of this invention mounted on a key chain 110.
Figure 3:
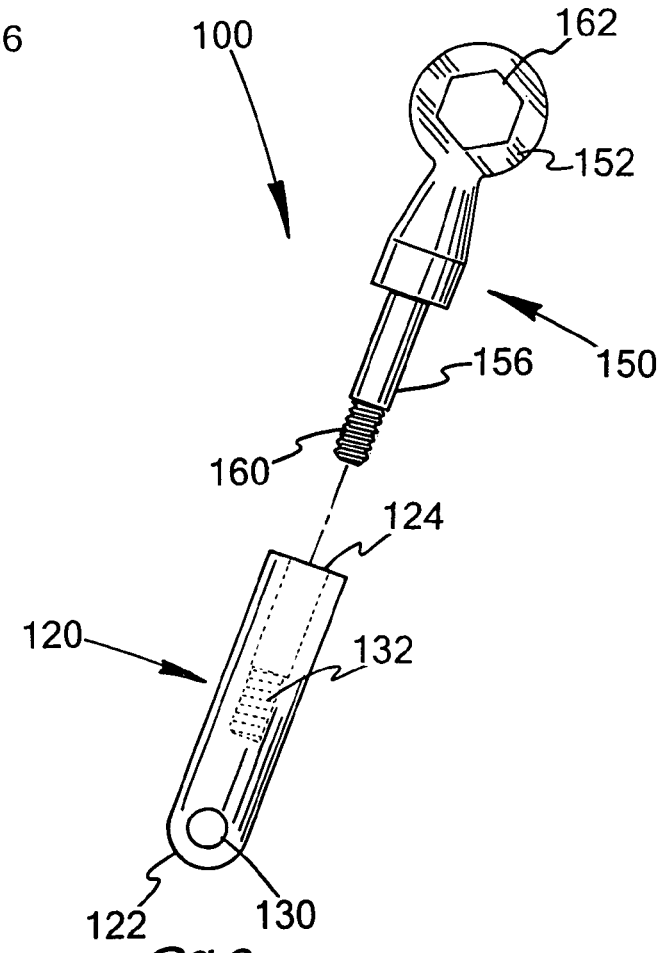
FIG. 3 depicts an exploded front plan view of an antenna wrench assembly 100 of this invention based on FIG. 2.
Figure 4:
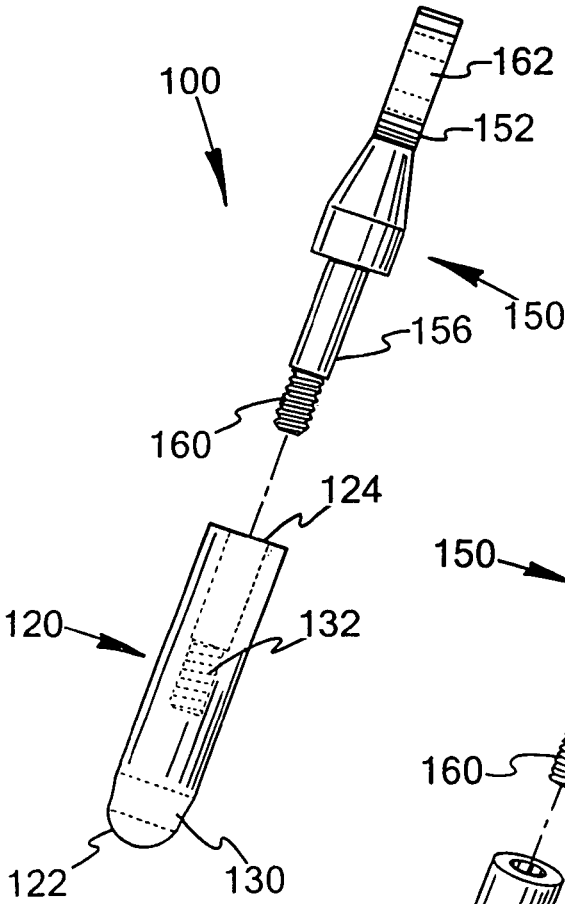
FIG. 4 depicts an exploded side view of an antenna wrench assembly 100 of this invention based on FIG. 3.

Adding FIG. 2, FIG. 3 and FIG. 4 to the discussion, one preferred embodiment of wrench assembly 100 may be seen. Within the supporting end 122 of mounting base 120 is a ring aperture 130. Oppositely disposed from ring aperture 130 on mounting base 120 is a receiving member 124 with threaded receiver 132 therein. On wrench 150 oppositely disposed from gripping member 152 at mating member 156 is set of wrench threads 160 adapted to mate in threaded relation with threaded receiver 132. Whether threaded receiver 132 and set of threads 160 join to mounting base 120 in a male to female relationship or female to male relationship, depends on the type of antenna 114 being removed from a vehicle 112.

Figure 9:
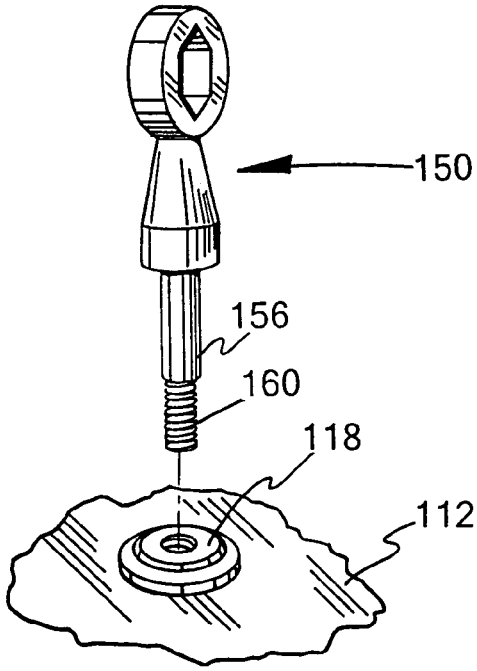
FIG. 9 depicts an exploded perspective view of wrench 150 of this invention in relation to vehicle 112.

Wrench 150 includes a gripping member 152 desirable fixed end nut grip 162. The nut grip 162 fits around the gripping shaft 116 of the antenna 114. Then wrench 150 may be used to fasten or tighten antenna 114. Set of threads 160, as shown in FIG. 9, are designed to fit into antenna mount 118 for antenna 114 on vehicle 112 and prevent water from entering the antenna mount 118, as the vehicle 112 is being washed.

Figure 5:
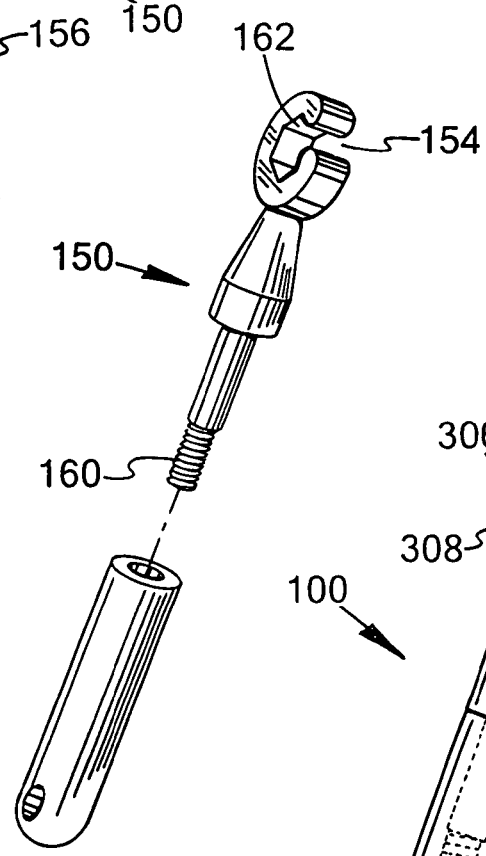
FIG. 5 depicts an exploded, perspective view of an antenna wrench assembly 100 with a slotted socket 154.

With the consideration of FIG. 5, a slotted socket 154 may be in the nut grip 162. Slotted socket 154 allows for the insertion of a narrow portion of the antenna 114. Consequently, in this embodiment, the removal of the antenna 114 does not require the user to insert the nut grip 162 of the wrench 150 through the top of the antenna 114. Instead, the user can now place a narrow portion of antenna 114 through the slotted socket 154. User can then lower the nut grip 162 around the gripping shaft 116.

Figure 6:
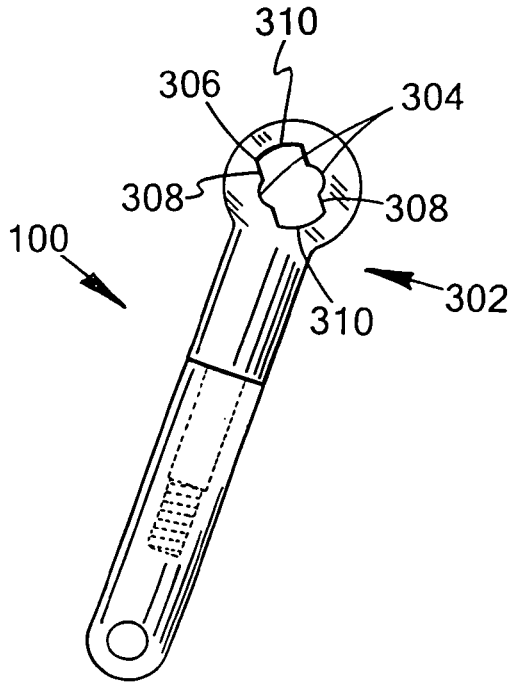
FIG. 6 depicts a front plan view of an antenna wrench assembly 100 of this invention with a flat side wrench head 250.

Referring now to FIG. 6, an antenna wrench assembly 100 with a flat antenna wrench grip 302 is shown. Vehicle antennas 114 and their corresponding gripping shafts 116 consist of a plurality of shapes. This invention is not limited to a particular shape of antenna 114 or gripping shaft 116. Consequently, FIG. 6 illustrates an embodiment of this invention designed to turn a flat antenna nut for gripping shaft 116. Flat antenna wrench grip 302 fits around and permits the rotation of the flat antenna nut, for removing or attaching of antenna 114. Flat antenna wrench grip 302 may have rounded edges 304 in order to permit the round ball at the end of an antenna 114 to fit through the flat antenna wrench grip 302. Furthermore, the configuration of the flat antenna wrench grip 302 may positioned at an offset angle 306 to facilitate use on the antenna. The long sides 308 of the flat antenna wrench grip 302 are at the slight offset angle 306 to the principal axis of the grip 302. Within long sides 308 are matching arcs 310 to facilitate passing thereof over the tip of antenna 114.

Figure 7:
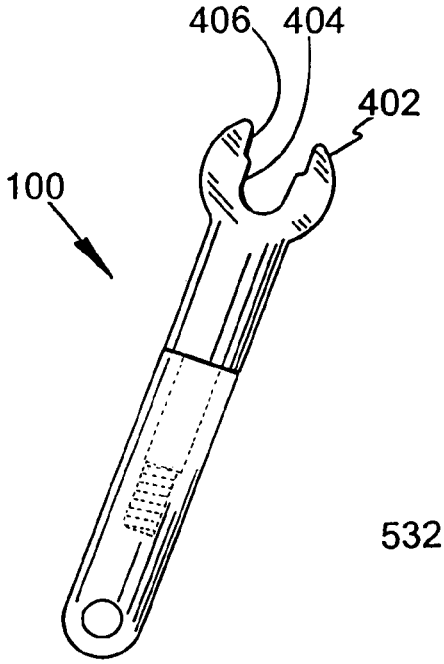
FIG. 7 depicts a front plan view of an antenna wrench assembly 100 of this invention with open wrench head 260.

Adding FIG. 7, an antenna wrench assembly 100 with a multiple head removal wrench grip 402 is shown. Multiple head removal wrench grips 402 are designed to remove antennas 114 of numerous designs and shapes. Furthermore, the wrench grip 402 is open at one end, removing the need to insert the wrench grip 402 through the top of the antenna 114. First grip level 404 is smaller than second grip level 406, and permits access to different types of antenna 114.

Figure 8:
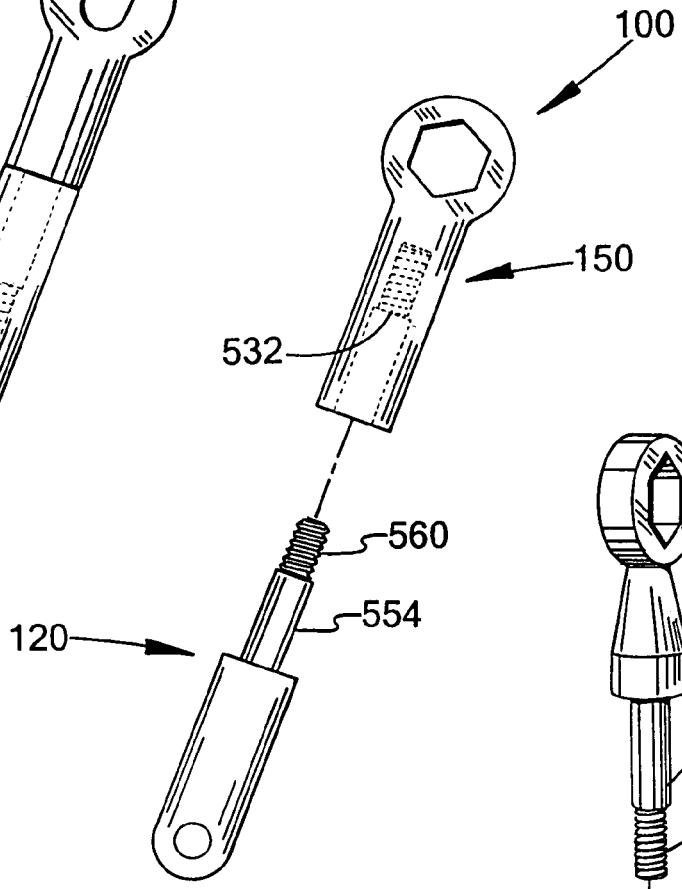
FIG. 8 depicts an exploded front plan view of an antenna wrench assembly 100 of this invention based on FIG. 2, with reversed thread assembly 278.

Finally, FIG. 8 illustrates the antenna wrench assembly 100 with the alternate antipodal attachment members on the wrench 150 and the mounting base 120. In this embodiment, wrench 150 has a female threaded receiver 532. Oppositely disposed is the mounting base 120 with the male mating member 554. Male mating member 554 contains male threads 560, which allow it to insert and connect the wrench 150 with the mounting base 120.

Accordingly, the antipodal member on the wrench assembly 100 corresponds to the antipodal member on the antenna 114. For example, if the antenna 114 contains a female connector and the antenna mount 118 contains a male connector, the wrench 150 has a female threaded receiver. Alternatively, if the antenna 114 contains a male connector and the antenna mount 118 contains a female connector, the wrench has male mating member attached thereto. Thus, the wrench 150 attaches to the corresponding threaded member on the vehicle 112. This protects the mounting structure of the antenna 114 during washing of the vehicle 112.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A wrench assembly mountable on a key chain for removing an antenna from a vehicle comprising:
   (a) a mounting base including a supporting end and a receiving member oppositely disposed from the supporting end;
   (b) a wrench including a gripping member and a mating member;
   (c) the mating member connecting with the receiving member thereby releasably securing the wrench with the mounting base;
   (d) the mating member and the receiving member being a pair of antipodal members; and
   (e) an antipodal from the pair of antipodal members on the mating member corresponding to an antipodal member on an antenna thereby allowing the wrench or the mounting base to be attached to an antenna mount on a vehicle and protect the antenna mount during a vehicle washing procedure.

2. The wrench assembly on a key chain for removing an antenna from a vehicle, according to claim 1, further comprising:
   (a) the gripping member on the wrench having a nut grip; and
   (b) the nut grip fitting around a gripping shaft of the antenna thereby allowing for the removal of the antenna.

3. The wrench assembly on a key chain for removing an antenna from a vehicle, according to claim 2, wherein the antipodal members being a threaded receiver and a set of threads adapted to mate in threaded relation with the threaded receiver.

4. The wrench assembly on a key chain for removing an antenna from a vehicle, according to claim 3, wherein the supporting end contains a ring aperture for a key ring.

5. The wrench assembly on a key chain for removing an antenna from a vehicle, according to claim 4, further comprising the nut grip having a slot to receive the antenna thereby permitting a user to insert he nut grip around the antenna.

6. The wrench assembly on a key chain for removing an antenna from a vehicle, according to claim 4, wherein:
   (a) the nut grip being a flat antenna wrench grip;
   (b) the flat antenna wrench grip having rounded edges in order to permit a rounded ball at the end of the antenna to fit through the flat antenna wrench grip;
   (c) the flat antenna wrench grip having a pair of long sides; and
   (d) the long sides being at a slight offset angel to the principal axis of the antenna wrench assembly.

7. The wrench assembly on a key chain for removing an antenna from a vehicle, according to claim 4, wherein the nut grip is a multiple head removal wrench grip.

8. A method of removing an antenna and protecting the antenna mount while washing a vehicle comprising:

(a) providing a wrench assembly with a mounting base including a supporting end and a receiving member oppositely disposed from the supporting end, a wrench composed of a gripping member and a mating member, the mating member connecting with the receiving member thereby releasably securing the wrench with the mounting base;

(b) releasing the wrench;

(c) removing the antenna with the wrench by fitting the gripping member with a nut grip around a gripping shaft of the antenna; and (d) attaching the mating member of the wrench to an antenna mount which mounts the antenna.

9. The method of removing an antenna and protecting the antenna mount while washing a vehicle, according to claim 8, further comprising:

(a) releasably securing the wrench with the mounting base by forming a pair of antipodal members on the mating member and the receiving member; and (b) corresponding the antipodal member on the mating member with the antipodal member on an antenna thereby allowing the wrench to be attached to an antenna mount.

10. The method of removing an antenna and protecting the antenna mount while washing a vehicle, according to claim 9, further comprising forming a threaded receiver and a set of threads adapted to mate in threaded relation with the threaded receiver as the antipodal members.

11. The method of removing an antenna and protecting the antenna mount while washing a vehicle, according to claim 10, further comprising forming a ring aperture on the supporting end for a key ring.

12. The method of removing an antenna and protecting the antenna mount while washing a vehicle, according to claim 11, further comprising forming a slot in the nut grip thereby not requiring user to insert the nut grip through the top of the antenna.

13. The method of removing an antenna and protecting the antenna mount while washing a vehicle, according to claim 11, further comprising:

(a) forming a flat antenna wrench grip with a pair of long sides as the nut grip;

(b) forming rounded edges in the flat antenna wrench grip in order to permit a rounded ball at the end of the antenna to fit through the flat antenna wrench grip; and (c) forming the long sides at a slight offset angle to the principal axis of the antenna wrench assembly.

14. The method of removing an antenna and protecting the antenna mount while washing a vehicle, according to claim 11, further comprising forming a multiple head removal wrench grip as the nut grip.

15. A wrench assembly for removing an antenna from a vehicle comprising:

(a) a mounting base including a supporting end and a receiving member oppositely disposed from the supporting end;

(b) a wrench composed of a gripping member and a mating member; and (c) the mating member connecting with the receiving member thereby releasably securing the wrench to the mounting base.

16. The wrench assembly on a key chain for removing an antenna from a vehicle, according to claim 15, wherein:

(a) the mating member and the receiving member being a pair of antipodal members;

(b) a mating antipodal member on the mating member corresponding to an antenna antipodal member on the antenna thereby allowing the wrench to be attached to an antenna mount;

(c) the gripping member on the wrench having a nut grip;

(d) the nut grip fitting around a gripping shaft of the antenna thereby allowing for the removal of the antenna;

(e) the antipodal members being a threaded receiver and a set of threads adapted to mate in threaded relation with the threaded receiver.

17. The wrench assembly on a key chain for removing an antenna from a vehicle, according to claim 16, wherein the supporting end contains a ring aperture for a key ring.

18. The wrench assembly on a key chain for removing an antenna from a vehicle, according to claim 16, wherein the nut grip having a slot thereby not requiring user to insert the nut grip through the top of the antenna.

19. The wrench assembly on a key chain for removing an antenna from a vehicle, according to claim 16, wherein:

(a) the nut grip being a flat antenna wrench grip;

(b) the flat antenna wrench grip haivng rounded edges in order to permit a rounded ball at the end of the antenna to fit through the flat antenna wrench grip;

(c) the flat antenna wrench grip having a pair of long sides; and (d) the long sides being at a slight offset angle to the principal axis of the antenna wrench assembly.

* * * * *